US008684152B2

(12) United States Patent
Angus

(10) Patent No.: US 8,684,152 B2
(45) Date of Patent: Apr. 1, 2014

(54) BUNCH MEDIA PROCESSING SYSTEM

(75) Inventor: Robin I. G. Angus, Fife (GB)

(73) Assignee: NCR Corporation, Duluth, GA (US)

( * ) Notice: Subject to any disclaimer, the term of this patent is extended or adjusted under 35 U.S.C. 154(b) by 1003 days.

(21) Appl. No.: 11/809,108

(22) Filed: May 31, 2007

(65) Prior Publication Data

US 2008/0230980 A1 Sep. 25, 2008

(30) Foreign Application Priority Data

Mar. 22, 2007 (GB) ..... 0705518.9

(51) Int. Cl.
*G07F 7/04* (2006.01)

(52) U.S. Cl.
USPC ..... 194/206

(58) Field of Classification Search
USPC ..... 209/534; 194/206, 207; 271/176, 216; 242/528
See application file for complete search history.

(56) References Cited

U.S. PATENT DOCUMENTS

| | | | | |
|---|---|---|---|---|
| 6,719,120 | B2 * | 4/2004 | Kato | 194/206 |
| 7,320,461 | B2 * | 1/2008 | Lofthus et al. | 271/3.14 |
| 7,494,046 | B2 * | 2/2009 | Graef et al. | 235/379 |
| 2005/0108165 | A1 * | 5/2005 | Jones et al. | 705/43 |

* cited by examiner

*Primary Examiner* — Jeffrey Shapiro
(74) *Attorney, Agent, or Firm* — Peter H. Priest; Michael Chan

(57) ABSTRACT

A bunch sheet media processing system for an Automated Teller Machine (ATM) having improved reliability. A bunch sheet media in-feed device and a validation device are interconnected by a sheet media transport system such that sheet media can be transported between the bunch sheet media in-feed device and the validation device without passing through a bunch media processing device.

13 Claims, 4 Drawing Sheets

BUNCH MEDIA PROCESSING SYSTEM

TECHNICAL FIELD

The present invention relates to a sheet media processing system. It is particularly related to, but in no way limited to, a bunch media processing system for an Automated Teller Machine (ATM).

BACKGROUND

In addition to the dispensing of money, Automated Teller Machines (ATMs) may also provide a deposit service to allow customers to deposit checks, notes or other items of sheet media into the machine for credit to their account, or for other purposes. In order to provide this service an ATM must have a system to accept and process the items of sheet media. As well as the storage of deposited items, an ATM may also provide services that require the return of the items to the customer.

A simple system for accepting items of sheet media is a single feed device, which accepts a single item at a time for processing. The customer must feed each item of sheet media to be deposited into the ATM one by one. A disadvantage of this system is that the deposit of more than a few items takes a substantial amount of time, and the customer is also required to manually select and insert each item to be deposited in turn.

In order to increase the speed of deposit of a number of items of sheet media, a system may be provided that allows a user to insert a number of items of media at a time. Such systems are known as bunch media processing systems. The items of media may be either stored or returned to the customer in a single bunch. This significantly improves the customer's experience as they are not required to separate and feed each item individually into the machine, thereby greatly reducing the processing time.

In order to facilitate the processing of bunches of media, escrow and re-presenter devices are provided in the processing system. An escrow device temporarily stores items of media such that all items in a bunch can be accepted into the processing system before it is decided where those items will be routed to. Re-presenter devices allow the recombination of single items of media into a stack of items, such that a bunch of items of media can be conveniently returned to a customer in one stack.

A disadvantage of bunch media processing systems is that because the devices are more complicated to allow the handling of bunches of items, they are more prone to malfunction and jamming. When conventional bunch media processing systems malfunction, the ATM is rendered unable to accept the deposit of any items and thus the functionality of that ATM is severely curtailed until a technician can visit the ATM to clear the jam or repair it.

There is therefore a requirement for a media processing system which addresses the above-mentioned problem.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

There is provided a bunch media processing system for an Automated Teller Machine (ATM), comprising a bunch sheet media in-feed device, a bunch media processing device arranged to escrow and represent items of sheet media, and a media validation device, the bunch sheet media in-feed device, bunch media processing device and media validation device being interconnected by a sheet media transport system for transporting sheet media between those devices, wherein the devices are interconnected by the sheet media transport system such that sheet media can be transported between the bunch sheet media in-feed device and the media validation device without entering the bunch media processing device.

Such a system has the advantage that the processing of bunches of items of sheet media can be continued in spite of the bunch media processing device jamming or malfunctioning. The transport system allows items of sheet media to be transported from the bunch in-feed device to the storage bin without entering the bunch media processing device, thereby allowing operation to continue.

The bunch media processing system may further comprise a storage bin, interconnected to the devices by the sheet media transport system, such that sheet media can be transported between the bunch sheet media in-feed device and the storage bin, via the media validation device, without entering the bunch media processing device.

The bunch media processing device may comprise an escrow device and a re-presenter device.

The bunch media processing system may further comprise a direction selector for directing sheet media from the output of the media validation device to either the storage bin or the bunch media processing device.

The bunch media processing system may further comprise a direction selector for directing sheet media from the output of the escrow device to either the storage bin or the re-presenter.

There is also provided a method of processing a bunch of items of sheet media using a bunch media processing system having an escrow device and a re-presenter device, comprising the steps of accepting a bunch of items of sheet media, separating an item of sheet media from the bunch of items of sheet media, validating that item of sheet media, and storing that item of sheet media, or returning it to a customer, without that item of sheet media entering the escrow or re-presenter devices.

An Automated Teller Machine (ATM) is provided having an aforementioned bunch media processing system.

Many of the attendant features will be more readily appreciated as the same becomes better understood by reference to the following detailed description considered in connection with the accompanying drawings. The preferred features may be combined as appropriate, as would be apparent to a skilled person, and may be combined with any of the aspects of the invention.

BRIEF DESCRIPTION OF THE DRAWINGS

Embodiments of the invention will be described, by way of example, with reference to the following drawings, in which.

DETAILED DESCRIPTION

Embodiments of the present invention are described below by way of example only. These examples represent the best ways of putting the invention into practice that are currently known to the Applicant although they are not the only ways in which this could be achieved.

Figure 1:
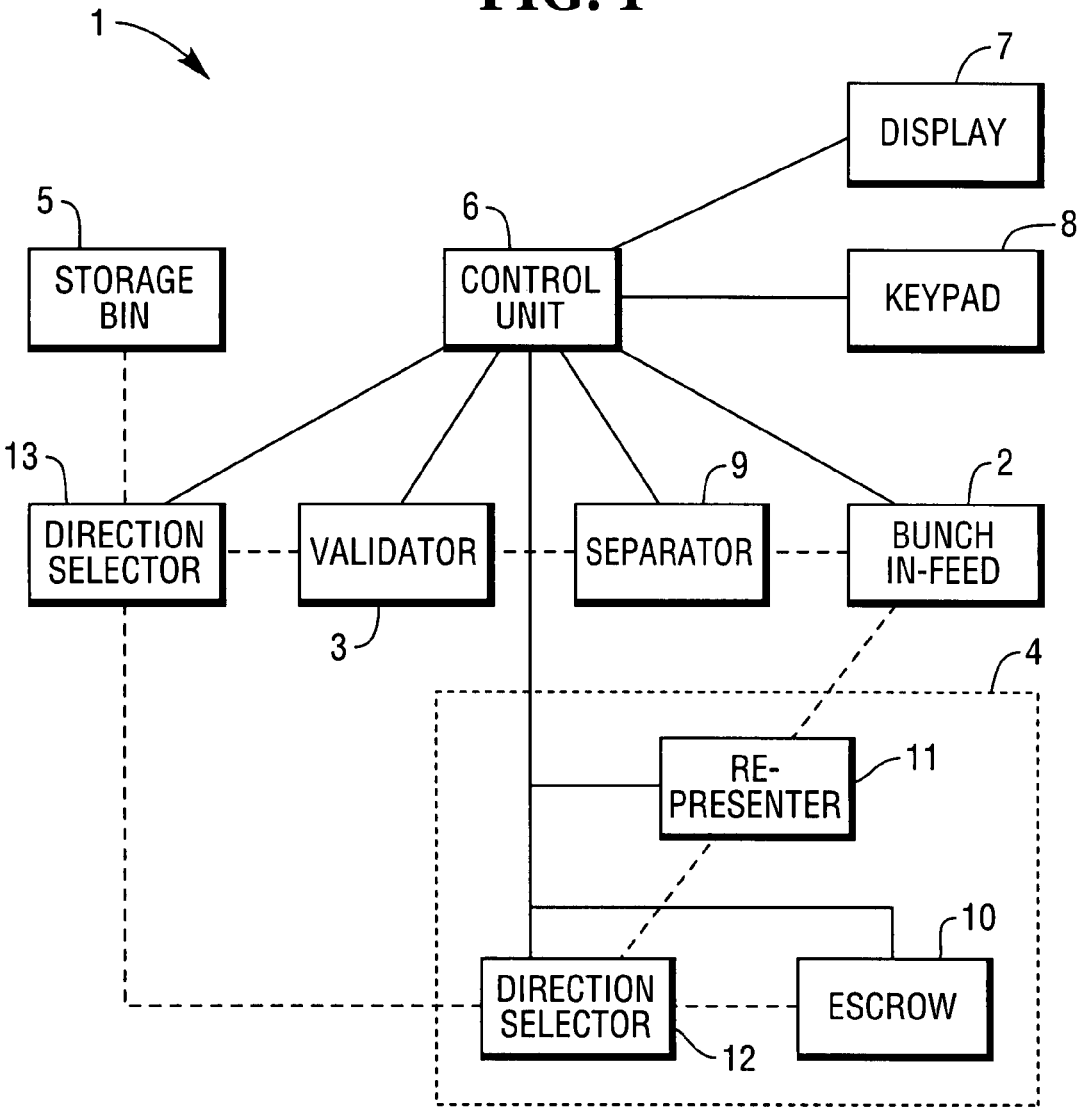
FIG. 1 is a block diagram of a bunch media processing system according to an embodiment of the invention (solid lines indicate signal paths, dashed lines indicate a physical path for items of media)

FIG. 1 shows a block diagram of a bunch media processing system which overcomes the problems of the prior art. The system can process media singly, or in bunches, thereby providing versatility and reliability to the customer. The problems of the prior art are overcome because, should the bunch processing facility fail, media can still be processed singly.

Processing system 1 has a bunch in-feed device 2, a separator 9, a validation device 3, a bunch processing device 4 and a storage bin 5. These are interconnected by a media transport system for transporting items of media between the devices (paths of which transport systems are shown by dashed lines). The transport system has direction selectors 12, 13 which select the path taken by media being transported by the transport system. The system 1 may be controlled by a control unit 6, which is connected to a display 7 and a keypad 8. The bunch processing device 4 has an escrow unit 10 and a re-presenter unit 11.

The bunch in-feed device 2 accepts a stack of sheet media from a customer, but is also capable of accepting single items of media. The separator 9 separates one item of media from the stack at a time and passes it to the transport system. If only a single item of media is inserted, that item is passed directly to the transport system and there is no need for the separation step.

The item of media is deskewed and passed to validation device 3 which validates the item of media using known techniques.

The direction selector 13 directs items of media either to the bunch processing device 4 or to the storage bin 5, depending upon instructions from the control system 6. The route is selected dependent upon the current function of the system.

If the item of media is directed to the bunch processing device 4, it passes either to the escrow unit 10 where it is temporarily stored or to the re-presenter 11; as determined by the direction selector 12 under control of the control unit 6. The next item of media is then separated from the deposited stack, and handled in the same fashion as described above. The processing of the subsequent item may begin before processing of the previous item is complete, provided that there is sufficient gap between the items for each item to be processed correctly without collisions occurring. The transport system may be independently controllable along the route of the items of media such that more than one item can be transported independently at a time.

The sequential processing of the items of media may continue until all of the items have been removed from the in-feed device and stored in the escrow device 10 or the re-presenter 11.

If the deposited items of media are to be returned to the user, but have been stored in the escrow unit 10, they are transferred out of the escrow unit 10 and passed to the re-presenter 11 which stacks the items of media into a single stack. The stack of media is then returned to the in-feed unit 2 by the transport system, from where it can be presented to the customer for collection.

If the items of media are to be stored in the storage bin 5 each item is routed back to the validation device 3, and then routed to the storage bin 5 by the direction selector 13 and transport system. Each item of media is thus stored in the storage bin. As described above, the processing of each subsequent item may begin before the previous item has completed the transfer to the storage bin 5. The direction selector 13 may be configured to direct items of media directly into the storage bin 5 without going via the validation device 3.

It is possible that some items of deposited media are to be returned to the customer, and some are to be placed in the storage bin 5. In that case, as each item is transferred out of the escrow unit 10 it is either directed to the storage bin 5, or it is directed to the re-presenter 11 and subsequently returned to the customer. For example, the reading system may have failed to read some items of the deposited media, and they may be returned to the user as they could not be verified. Those items of media that could be verified are stored in the storage bin 5. Furthermore, some or all of the items of media may be directed directly to the storage bin 5, without first being directed to the bunch processing device 4.

If only a single item of media is to be processed by the ATM, it may be directed directly to the storage bin by the selector direction 13, rather than to the bunch processing unit 4. Furthermore, if that single item of media is to be returned to the customer, it can be transferred in the reverse direction back to the customer, without passing through the bunch processing device 4.

A control unit 6 controls the functioning of the system, and controls the various devices depending upon the function being performed. The function will depend upon the selections made by the customer using the display screen 7 and keypad 8 of the ATM, and the nature of the media inserted by the customer. The control may also take input from the validation device 3 and control parts of the system dependent upon the signals received. For example, depending upon the data read from the media by the validation device, it may either be returned to the customer, or stored in a storage bin 5 by appropriate control of the movement of the media by the transport system and the direction selectors 12, 13.

The bunch processing device 4 (escrow unit 11 & re-presenter 10) is more complex than the other sections of the system. They are more prone to jamming due to the more complicated structure and their handling of a number of items of media at the same time. A disadvantage of prior art bunch media handling systems has been that this reduced reliability has impacted the reliability of the whole system, as failure of the bunch processing part caused failure of the ability to accept items of media. However, the design of the current system allows operation of the system to continue, even if the bunch processing unit fails.

Sensors are provided in the bunch processing device 4 to detect when a malfunction or jam occurs. Such a problem is signaled to the control unit 6, which then controls the system in such a way that operation can be continued, but with reduced functionality.

As can be seen in FIG. 1, in a system according to an embodiment of the invention, the path from the in-feed device to the storage bin 5 via the validation device 3 is entirely independent of the bunch processing device 4. It is therefore possible to continue operation of the system when the bunch processing device 4 is not functioning, but only a single item of media can be handled at a time. The availability of the ATM is thus improved by allowing operation to continue until the bunch device 4 can be repaired.

When the bunch processing device 4 is unavailable, a warning may be displayed to customers to indicate that the ATM is operating in a reduced functionality state. The level of functionality will depend upon the particular service required by each customer.

Figure 2:
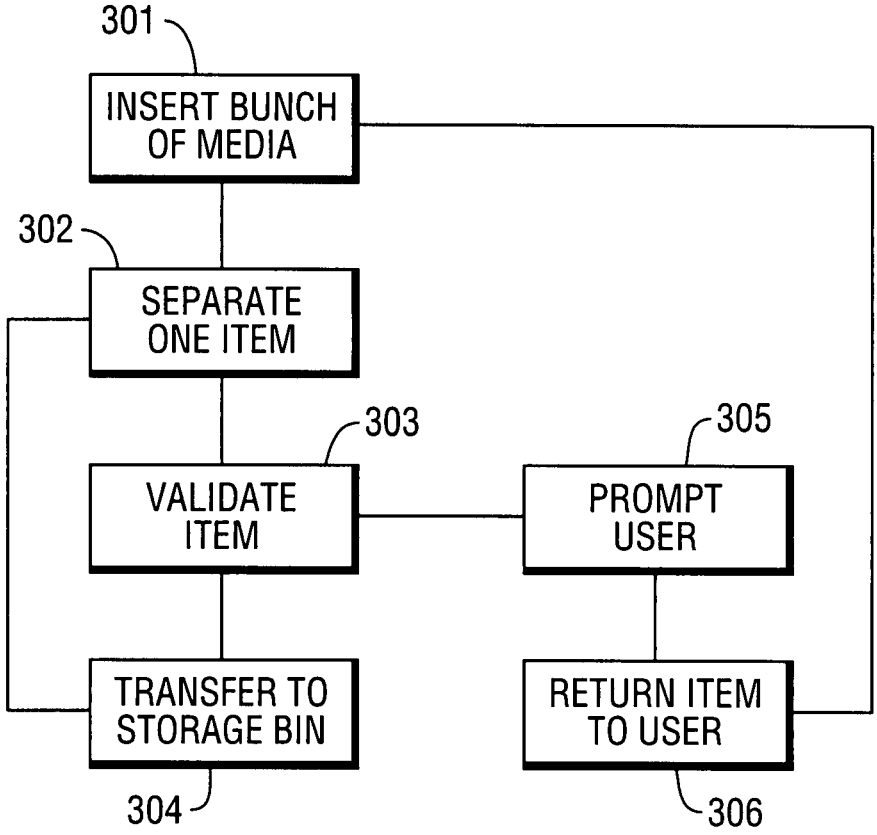
FIG. 2 is a flow-chart of an embodiment of the invention operating in a reduced function mode.

Due to the reduced functionality of the ATM, the operation is dependent upon the service required by the customer. FIG. 2 shows a flow chart of a deposit service when operating in a reduced mode.

At step 301 the user inserts a bunch of media into the in-feed device 2 in the normal manner. At step 302 a single item of media is separated from the stack and passed to the validation device 3, which validates the media in the normal manner (Step 303). If the item of media is successfully validated it is transferred to the storage bin 5 (Step 304) and the next item of media is separated from the stack (Step 302) and handled in the same way. This process is repeated until all of the items of media have been processed and stored.

If an item of media cannot be validated successfully, the user is prompted to remove the stack of media from the in-feed device (Step 305), and the item of media being processed is subsequently returned (Step 306) to the in-feed device. Once the customer has removed the returned item, further items of media can be inserted into the in-feed device and the process restarted (Step 301).

Figure 3:
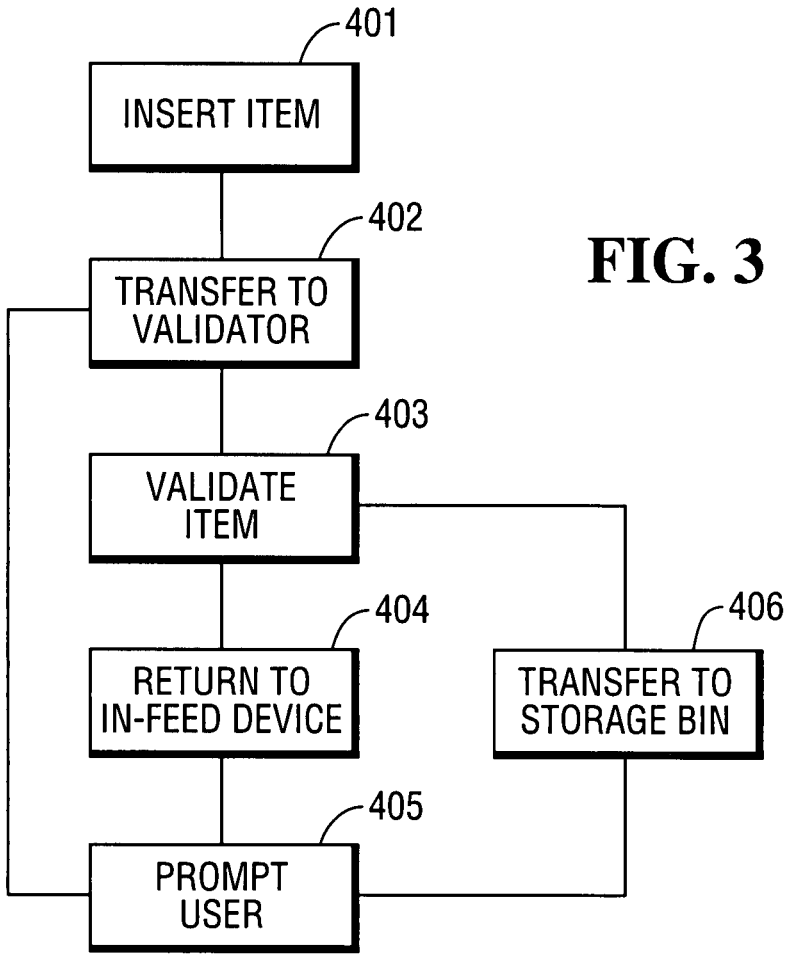
FIG. 3 is a flow-chart of an embodiment of the invention operating in a reduced function mode.

FIG. 3 shows a flow chart of a service for processing single items at a time.

The display indicates that the ATM is operating in a reduced service configuration, and that for the service requested only a single item can be accepted at a time. At step 401 the user is prompted to insert the first item of media into the in-feed device 2 and it is transferred from there to the validation device (Step 402). The item of media is validated in the usual manner (Step 403). Depending upon the result of the validation, the item may either be returned to the in-feed device for the customer (Step 404), or transferred to the storage bin for storage (Step 406).

At step 405 the customer is prompted to insert the next item of media which is handled in the same way. The customer can thus complete the transaction with all items of media, but at a reduced speed as each item of media must be inserted individually in turn. However, prior art systems would not be able to provide any service.

Figure 4:
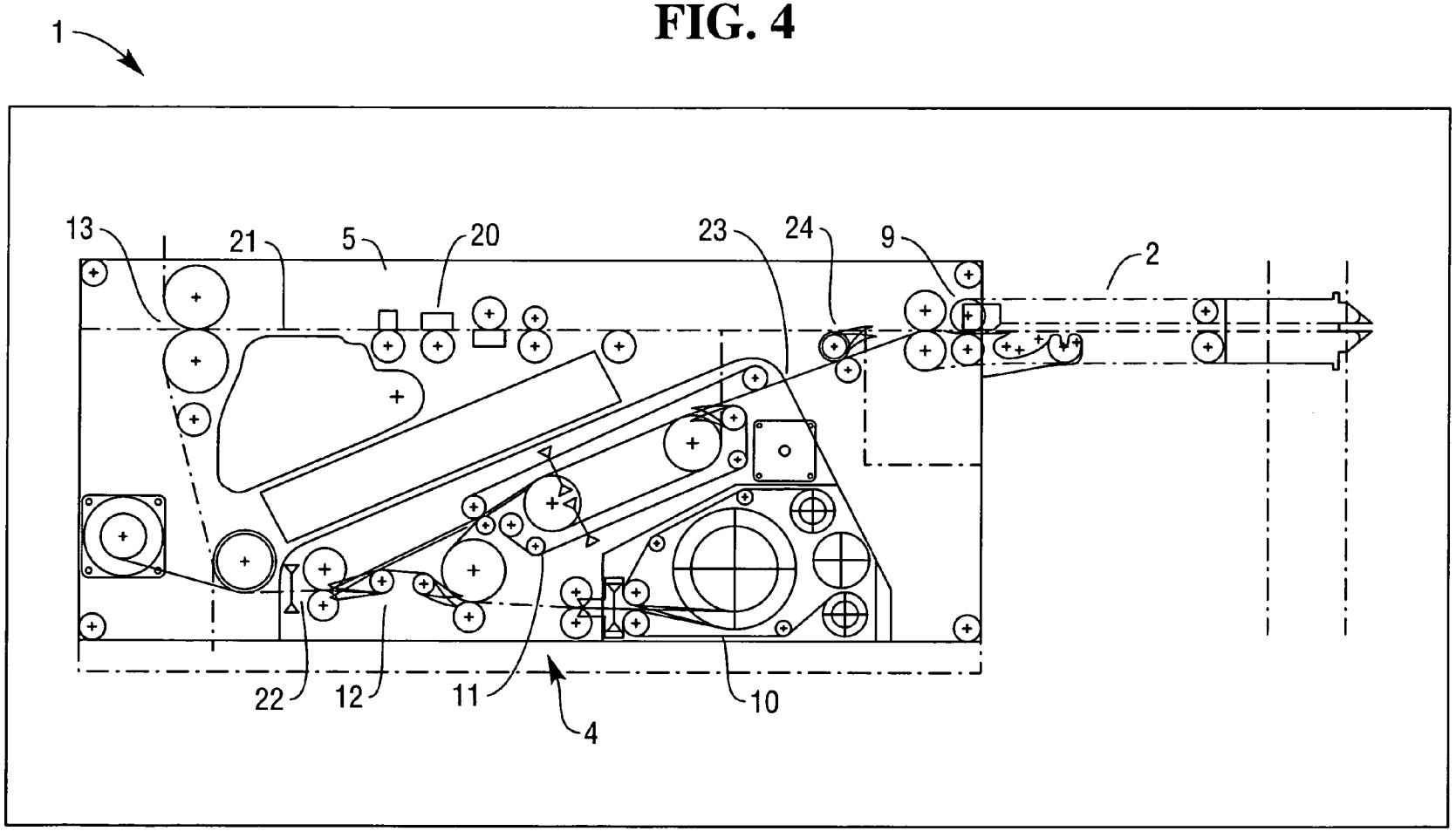
FIG. 4 is a diagram of an embodiment of the invention.

FIG. 4 shows an embodiment of the system shown in FIG. 1. A bunch in-feed device 2 is provided into which a customer can place bunches, or single items, of sheet media. Separator 9 separates single items of media from a bunch in the in-feed device and passes them to the transport system (not shown in detail) for transfer through the system. Separator 9 and bunch in-feed device 2 can also be utilized to present bunches of items, or single items, to the customer.

The validation device comprises cameras and MICR heads 20. The cameras capture an image of items of sheet media, which images may be stored and/or analyzed to authenticate deposited items. A printer 21 allows items of sheet media to be marked. For example, the time and date of deposit may be marked for later reference. Direction selector 13 allows items of sheet media to either be directed to the bunch processing device 4, or to a storage bin located above, or to the left, of the processing system. The location of the storage bin will depend upon the particular configuration of the ATM in which the processing system is utilized. Possible paths in both directions may be provided such that the same processing system can be used in a range of ATM configurations.

Bunch processing device 4 is provided as a separate module to the other parts of the system. This provides versatility in the design as it allows the same processing system be utilized with, or without, a bunch processing facility. Bunch processing device 4 can be included upon assembly of the system, or added later as an upgrade. If the system is configured without the bunch processing device 4, a single sheet in-feed device could also be fitted in place of the bunch sheet in-feed device 2.

Bunch processing device 4 comprises an escrow unit 10, a re-presenter 11 and a direction selector 12. The direction selector allows items of sheet media to be directed between the input 22 to the bunch processing device 4 and the re-presenter and escrow devices 11, 10. An output 23 of the bunch processing device directs items of sheet media (bunches or singly) from the re-presenter 11 to the separator 9 and bunch in-feed device 2. Direction selector 24 allows items of sheet media from the separator 9 to be directed either to the validation device 5 as described above, or directly to the bunch processing device 4.

The devices of the system 1 are interconnected by a transport system to transport items of sheet media between the devices. The transport system may be provided as is known in the art, for example utilizing rollers or belts.

The system of FIG. 2 provides the functionality described in relation to FIG. 1, and the advantages thereof.

As will be apparent to the person skilled in the art, the above methods of operation are given as examples only and other processes and methods may be implemented using the system described hereinbefore. In particular, different patterns of validation, storage and return may be provided. Furthermore, additional displays may be provided to inform the user of the status and progress of processing and to provide different instructions to the user.

FIG. 4 shows one embodiment of the invention, but other layouts of the components of a media processing system are equally applicable, whilst still providing the features of the current invention; namely the ability to continue processing deposited media when there is a malfunction or jam of the bunch media section of the system.

The validation device has been described as comprising a camera, MICR heads and a printer, but additional, or fewer, components may be provided depending upon the functionality required of that section of the system. The bunch media processing device has been described as comprising an escrow device 10 and a re-presenter 11 but additional, or fewer, components may be provided.

In addition to the paths described above, the direction selectors may also direct media along different paths. For example, a path may be provided from the validation device 5, to the re-presenter 11, without the items of media first passing to the escrow device 10, as in the above description.

The above-description has made reference to a single storage bin, but further bins may also be provided, together with associated transport systems, such that items of media can be stored in a selected one of the storage bins, for example bank-notes which do not appear to be valid may be stored separately to apparently valid ones.

The bunch in-feed device 2 and separator 9 have been described as separate devices, but may also be provided as a single device providing the functionality described herein before.

Any range or device value given herein may be extended or altered without losing the effect sought, as will be apparent to the skilled person.

It will be understood that the benefits and advantages described above may relate to one embodiment or may relate to several embodiments. It will further be understood that reference to 'an' item refer to one or more of those items.

It will be understood that the above description of a preferred embodiment is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the spirit or scope of this invention.

What is claimed is:

1. A bunch media processing system for an automated teller machine (ATM) which can operate in a bunch-of-sheets feeding mode and in a single-sheet-only feeding mode when the ATM is unable to operate in the bunch-of-sheets feeding mode, the system comprising:

a bunch sheet media in-feed device arranged to (i) receive a bunch of sheet media items deposited by an ATM customer when the ATM is operating in the bunch-of-sheets feeding mode, and (ii) receive only one single-sheet media item at a time deposited by the ATM customer when the ATM is operating in the single-sheet-only feeding mode;

a sheet media validation device arranged to validate sheet media items;

a storage bin arranged to receive sheet media items which have been validated by the validation device;

a bunch sheet media processing device arranged to process sheet media items when the ATM is operating in the bunch-of-sheets feeding mode;

at least one sensor associated with the bunch sheet media processing device and arranged to provide a sensor output signal which is indicative of a malfunction associated with the bunch sheet media processing device;

a media transport including (i) a first transport path which extends between the in-feed device and the storage bin and passes through both the validation device and the bunch sheet media processing device, and (ii) a second transport path which extends between the in-feed device and the storage bin and passes through only the validation device and not the bunch sheet media processing device; and a control unit arranged to (i) monitor the sensor output signal from the at least one sensor, (ii) control the devices to operate in the bunch-of-sheets feeding mode when no sensor output signal is detected such that a sheet media item can be transported along the first transport path through both the validation device and the bunch sheet media processing device to the storage bin, and (iii) control the devices to operate in the single-sheet-only feeding mode when the sensor output signal is detected such that a sheet media item can be transported along the second transport path through only the validation device and not the bunch sheet media processing device to the storage bin.

2. A bunch media processing system according to claim 1, wherein the bunch sheet media processing device includes (i) an escrow unit arranged to receive non-validated sheet media items from the validation device, and (ii) a re-presenter unit arranged to receive sheet media items from the escrow unit to stack the sheet media items into a single stack for returning to the ATM customer.

3. A bunch media processing system according to claim 1, wherein the media transport includes a direction selector movable between a first position in which validated sheet media items can be transported along a portion of the second transport path from the validation device to the storage bin and a second position in which sheet media items can be transported along a portion of the first transport path from the validation device to the bunch sheet media processing device.

4. A method of processing a bunch of sheet media items deposited at an automated teller machine (ATM) which can operate in a bunch-of-sheets feeding mode and in a single-sheet-only feeding mode when the ATM is unable to operate in the bunch-of-sheets feeding mode, the method comprising:

receiving a bunch of sheet media items deposited by an ATM customer when the ATM is operating in the bunch-of-sheets feeding mode;

receiving only one single-sheet media item at a time deposited by the ATM customer when the ATM is operating in the single-sheet-only feeding mode;

validating sheet media items received from the ATM customer;

monitoring a sensor output signal from at least one sensor associated with a bunch sheet media processing device to detect a malfunction associated with the bunch sheet media processing device;

controlling operation of the ATM in the bunch-of-sheets feeding mode when no sensor output signal is detected such that a sheet media item can be transported along a first transport path which passes through the bunch sheet media processing device to a storage bin; and controlling operation of the ATM in the single-sheet-only feeding mode when the sensor output signal is detected such that a sheet media item can be transported along a second transport path which does not pass through the bunch sheet media processing device to the storage bin.

5. An automated teller machine (ATM) which can operate in a bunch-of-sheets feeding mode and in a single-sheet-only feeding mode when the ATM is unable to operate in the bunch-of-sheets feeding mode, the ATM comprising:

a bunch sheet media in-feed device arranged to (i) receive a bunch of sheet media items deposited by an ATM customer when the ATM is operating in the bunch-of-sheets feeding mode, and (ii) receive only one single-sheet media item at a time deposited by the ATM customer when the ATM is operating in the single-sheet-only feeding mode;

a sheet media validation device arranged to validate sheet media items;

a storage bin arranged to receive sheet media items which have been validated by the validation device;

a bunch sheet media processing device arranged to process sheet media items when the ATM is operating in the bunch-of-sheets feeding mode;

at least one sensor associated with the bunch sheet media processing device and arranged to provide a sensor output signal which is indicative of a malfunction associated with the bunch sheet media processing device;

a media transport including (i) a first transport path which extends between the in-feed device and the storage bin and passes through both the validation device and the bunch sheet media processing device, and (ii) a second transport path which extends between the in-feed device and the storage bin and passes through only the validation device and not the bunch sheet media processing device; and a control unit arranged to (i) monitor the sensor output signal from the at least one sensor, (ii) control the devices to operate in the bunch-of-sheets feeding mode when no sensor output signal is detected such that a sheet media item can be transported along the first transport path through both the validation device and the bunch sheet media processing device, and (iii) control the devices to operate in the single-sheet-only feeding mode of operation when the sensor output signal is detected such that a sheet media item can be transported along the second transport path through only the validation device and not the bunch sheet media processing device to the storage bin.

6. An ATM according to claim 5, wherein the bunch sheet media processing device includes (i) an escrow unit arranged to receive non-validated sheet media items from the validation device, and (ii) a re-presenter unit arranged to receive sheet media items from the escrow unit to stack the sheet media items into a single stack for returning to the ATM customer.

7. An ATM according to claim 5, wherein the media transport includes a direction selector movable between a first position in which validated sheet media items can be transported along a portion of the second transport path from the validation device to the storage bin and a second position in which sheet media items can be transported along a portion of the first transport path from the validation device to the bunch sheet media processing device.

8. A bunch media processing system according to claim 1, wherein (i) the media transport includes a third transport path which extends between the in-feed device and itself and passes through both the validation device and the bunch sheet media processing device, and (ii) the control unit is arranged to control the devices to operate in the bunch-of-sheets feeding mode when no sensor output signal is detected such that sheet media items can be transported along the third transport path through both the validation device and the bunch sheet media processing device and back to the in-feed device to return the sheet media items to the ATM customer.

9. A bunch media processing system according to claim 8, wherein (i) the media transport includes a fourth transport path which extends between the in-feed device and itself and passes through only the validation device and not the bunch sheet media processing device, and (ii) the control unit is arranged to control the devices to operate in the single-sheet-only feeding mode when the sensor output signal is detected such that a single sheet media item can be transported along the fourth transport path through only the validation device and not the bunch sheet media processing device and back to the in-feed device to return the single sheet media item to the ATM customer.

10. A method according to claim 4, further comprising:

controlling operation of the ATM in the bunch-of-sheets feeding mode when no sensor output signal is detected such that sheet media items can be transported along a third transport path which passes through the bunch sheet media processing device to return the sheet media items to the ATM customer.

11. A method according to claim 10, further comprising:

controlling operation of the ATM in the single-sheet-only feeding mode when the sensor output signal is detected such that a single non-validated sheet media item can be transported along a fourth transport path which does not pass through the bunch sheet media processing device to return the single non-validated sheet media item to the ATM customer.

12. An ATM according to claim 5, wherein (i) the media transport includes a third transport path which extends between the in-feed device and itself and passes through both the validation device and the bunch sheet media processing device, and (ii) the control unit is arranged to control the devices to operate in the bunch-of-sheets feeding mode when no sensor output signal is detected such that sheet media items can be transported along the third transport path through both the validation device and the bunch sheet media processing device and back to the in-feed device to return the sheet media items to the ATM customer.

13. An ATM according to claim 12, wherein (i) the media transport includes a fourth transport path which extends between the in-feed device and itself and passes through only the validation device and not the bunch sheet media processing device, and (ii) the control unit is arranged to control the devices to operate in the single-sheet-only feeding mode when the sensor output signal is detected such that a single sheet media item can be transported along the fourth transport path through only the validation device and not the bunch sheet media processing device and back to the in-feed device to return the single sheet media item to the ATM customer.

* * * * *